US007694372B1

(12) United States Patent
Boyd

(10) Patent No.: US 7,694,372 B1
(45) Date of Patent: Apr. 13, 2010

(54) AIR MATTRESS

(76) Inventor: Dennis Boyd, 14457 Rouge River, Chesterfield, MO (US) 63017

( * ) Notice: Subject to any disclaimer, the term of this patent is extended or adjusted under 35 U.S.C. 154(b) by 0 days.

(21) Appl. No.: 12/419,434

(22) Filed: Apr. 7, 2009

(51) Int. Cl.
*A47C 27/08* (2006.01)

(52) U.S. Cl. ..... 5/712; 5/711

(58) Field of Classification Search ..... 5/712, 5/711, 706–710, 713–715, 644, 654, 655.3, 5/682
See application file for complete search history.

(56) References Cited

U.S. PATENT DOCUMENTS

| | | | | |
|---|---|---|---|---|
| 277,979 | A * | 5/1883 | Blochman et al. | 5/712 |
| 388,037 | A * | 8/1888 | Hargin | 5/708 |
| 2,604,641 | A | 7/1952 | Reed | |
| 2,614,272 | A | 10/1952 | George | |
| 3,042,941 | A | 7/1962 | Marcus | |
| 3,251,075 | A | 5/1966 | Saltness et al. | |
| 3,644,950 | A | 2/1972 | Lindsay, Jr. | |
| 3,772,717 | A | 11/1973 | Yuen et al. | |
| 3,879,776 | A | 4/1975 | Solen | |
| 4,225,989 | A | 10/1980 | Corbett et al. | |
| 4,371,997 | A | 2/1983 | Mattson | |
| 4,424,600 | A | 1/1984 | Callaway | |
| 4,803,744 | A | 2/1989 | Peck et al. | |
| 4,896,389 | A | 1/1990 | Chamberland | |
| 5,044,030 | A | 9/1991 | Balaton | |
| 5,072,469 | A | 12/1991 | Boyd | |
| 5,107,557 | A | 4/1992 | Boyd | |
| 5,115,526 | A | 5/1992 | Boyd | |
| 5,243,722 | A | 9/1993 | Gusakov | |
| 5,423,094 | A | 6/1995 | Arsenault et al. | |
| 5,490,295 | A | 2/1996 | Boyd | |
| 5,493,742 | A | 2/1996 | Klearman | |
| 5,566,408 | A | 10/1996 | McCarthy et al. | |
| 5,598,593 | A | 2/1997 | Wolfe | |
| 5,630,237 | A | 5/1997 | Ku | |
| 5,638,565 | A | 6/1997 | Pekar | |
| 5,647,078 | A | 7/1997 | Pekar | |
| 5,647,079 | A | 7/1997 | Hakamiun et al. | |
| 5,711,041 | A | 1/1998 | Chen | |
| 5,727,270 | A | 3/1998 | Cope et al. | |
| 5,740,573 | A | 4/1998 | Boyd | |
| 5,890,245 | A | 4/1999 | Klearman et al. | |
| 6,073,291 | A | 6/2000 | Davis | |
| 6,148,461 | A | 11/2000 | Cook et al. | |
| 6,332,760 | B1 | 12/2001 | Chung | |
| 6,568,011 | B2 | 5/2003 | Fisher et al. | |
| 6,618,884 | B1 | 9/2003 | Wu | |
| 6,701,559 | B2 | 3/2004 | Boso | |
| 6,983,502 | B2 | 1/2006 | Boyd | |
| 7,152,264 | B2 | 12/2006 | Boyd | |
| 7,165,283 | B2 | 1/2007 | Boso et al. | |
| 7,234,184 | B2 * | 6/2007 | Yang | 5/712 |
| 7,353,555 | B2 | 4/2008 | Lau | |
| 7,367,073 | B2 | 5/2008 | Boyd | |
| 7,380,300 | B2 | 6/2008 | Boyd | |
| 2006/0288489 | A1 * | 12/2006 | Yang | 5/712 |

* cited by examiner

*Primary Examiner*—Robert G Santos
(74) *Attorney, Agent, or Firm*—H. Frederick Rusche; Husch Blackwell Sanders LLP

(57) ABSTRACT

An air mattress includes an inflatable compartment having a length and width, when inflated, sufficient to support a human body; an internal, generally horizontal wall located between the top and bottom of the compartment and connected to and horizontally restraining the sides of the compartment; at least one internal, generally vertical member connected to and restraining the relative vertical movement of the top and bottom of the compartment; and wherein one of the internal, generally vertical member and the internal, generally horizontal wall possesses an opening that permits at least a portion of the other structure to pass therethrough without interruption.

19 Claims, 11 Drawing Sheets

AIR MATTRESS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates generally to air mattresses and more particularly to an improved air mattress that reduces the amount of polyvinylchloride necessary to manufacture the mattress.

Almost all current air mattress use polyvinylchloride ("PVC") or thermoplastic polyurethanes ("TPU") as the primary or exclusive materials for manufacture. These materials are widely available, adaptable to many forms of use, and provide the stable and flexible structure necessary for these mattresses. However, greater attention has been recently focused on the potential environmental pitfalls of both PVC and TPU. In particular, concerns revolve around the plasticizers that must be used with PVC in order to make the material flexible. These plasticizers may leach out of the PVC sheets used to produce air mattresses and have been connected to significant potential health hazards. In addition, PVC, and to a lesser extent TPU, takes hundreds of years to degrade in landfills.

Other drawbacks to the use of these materials include cost and weight. These are petroleum-based products and, therefore, the cost associated with these materials can vary greatly with fluctuations in the price of oil. Furthermore, the weight of these materials can present issues for the manufacturer in shipping the products and for the consumer in carrying the mattress.

Therefore, it would be desirable to produce an air mattress capable of reduced usage of PVC and TPU while maintaining the same performance characteristics of current mattresses.

Standard mattresses, and in particular, "pillowtop" designs, tend to utilize a basic structure that involves top and bottom horizontal layers of vinyl that are separated by one or more internal, horizontal layers of vinyl on the interior of the mattress. These internal layers serve to restrain the sides of the mattress when the mattress is loaded. These layers can also serve to isolate the mattress into separate upper and lower chambers, if desired. These mattress also utilize multiple, vertically-oriented members or "beams" that traverse the interior of the mattress from side to side. These beams serve to provide vertical support to the mattress and help prevent "bowing" of the mattress during loading.

In these standard mattresses, it is obviously necessary to secure the beams to the exterior layers of vinyl. However, in mattresses utilizing an internal horizontal layer, it is necessary to actually utilize two sets of beams—one above and one below the internal horizontal layer, and to secure, by sonic welding, for example, each beam to the internal horizontal layer and, as appropriate, either the top or bottom external layer of the mattress. This structure results in a large number of seam points, requiring extensive labor on such mattresses.

Therefore, it would be desirable to produce an air mattress having an internal structure capable of restraining the external surfaces of the mattress from bowing while reducing the number of seam points and, consequently, the amount of labor involved in manufacturing such mattresses.

Finally, higher end versions of these standard mattresses utilize a flocked material on the upper, exterior (or sleeping) surface of the mattress. These flocked surfaces are intended to enhance the aesthetic appeal and comfort of the mattress by providing a somewhat softer, non-vinyl surface for the user to rest upon. These surfaces are almost universally made of very fine polyester fibers that are flocked to the upper vinyl layer of the mattress. Flocking is a process that involves applying an adhesive to the surface to be flocked and ionizing the surface, typically by applying an electric field to the surface. The ionized surface attracts the flocking material to the surface in a relatively even layer where the material is then secured to the surface by the adhesive.

While the flocked polyester material does provide a somewhat softer feel to the mattress, it is not an ideal sleeping surface. In particular, the flocked polyester surface does not "breathe" as the user lies on the surface. This feature can lead to moisture, in the form of the user's own perspiration and other natural secretions, collecting on the flocked surface. This collected surface moisture, especially when combined with the elevated surface temperatures resulting from the user's body heat, produces ideal conditions for rapid bacterial growth on the mattress surface. An alternative to polyester flocking is laminating a woven material to the top surface of the mattress. While this approach does produce a more breathable surface, it is also adds significant expense to the overall manufacturing process.

Therefore, it would be desirable to produce an air mattress having a sleeping surface that provides the preferred aesthetic appeal and comfort of a flocked surface while providing an impediment to bacterial growth and avoiding a significant increase in the cost to produce the mattress.

SUMMARY OF THE INVENTION

Among the various features of the present invention may be noted the provision of an air mattress having enhanced environmental qualities.

Another feature is the provision of such an air mattress with an enhanced internal structure that simplifies the manufacturing process.

A third feature is the provision of such an air mattress with enhanced comfort, aesthetic, and health characteristics.

Other objects and features will be in part apparent and in part pointed out hereinafter.

Briefly, in its broadest aspect, an air mattress of the present invention includes an inflatable compartment having a length and width, when inflated, sufficient to support a human body; an internal, generally horizontal wall located between the top and bottom of the compartment that serves to horizontally restraining the sides of the compartment; at least one internal member connected to and restraining the relative vertical movement of the top and bottom surfaces of the compartment; and wherein either the internal member of the internal, horizontal wall have at least one opening that permits at least a portion of the other structure to pass through without interruption.

In an alternate embodiment, the air mattress incorporates various components manufactured from non-vinyl materials to enhance the overall weight, aesthetics, and comfort of the mattress.

These aspects are merely illustrative of the various aspects associated with the present invention and should not be deemed as limiting in any manner. These and other objects, aspects, features and advantages of the present invention will become apparent from the following detailed description when taken in conjunction with the referenced drawings.

BRIEF DESCRIPTION OF THE DRAWINGS

Reference is now made to the drawings which illustrate the best known mode of carrying out the invention and wherein the same reference numerals indicate the same or similar parts throughout the several views.

DESCRIPTION OF THE PREFERRED EMBODIMENT

In the following detailed description, numerous specific details are set forth in order to provide a thorough understanding of the invention. However, it will be understood by those skilled in the art that the present invention may be practiced without these specific details. For example, well-known methods, procedures, and components have not been described in detail so as not to obscure the present invention.

Figure 1:
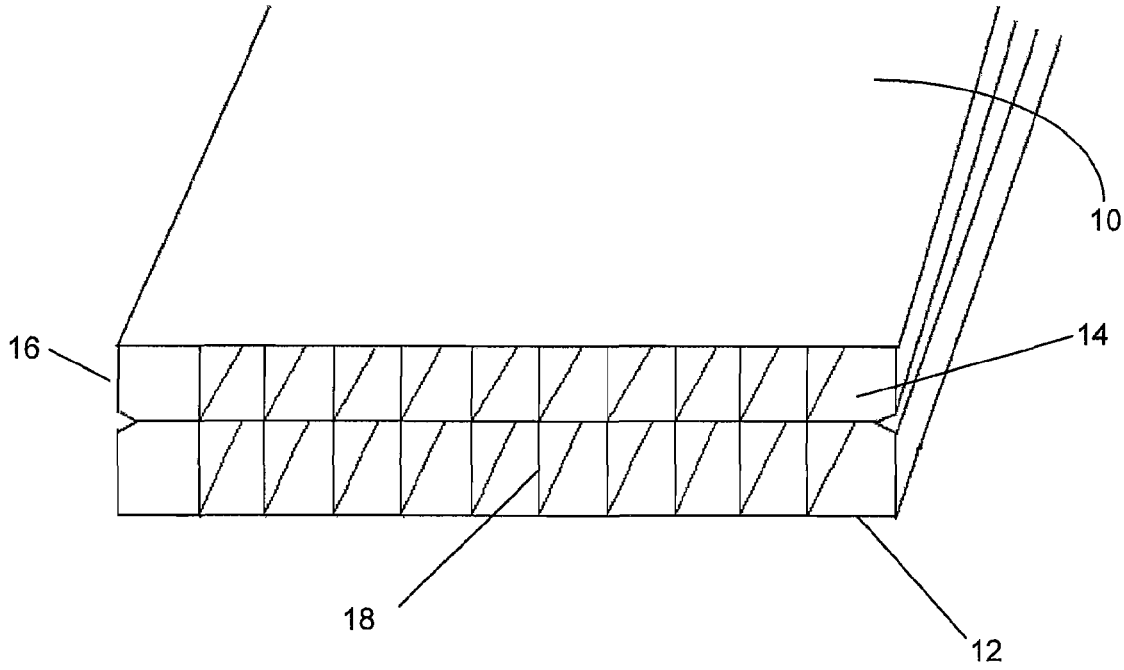
(PRIOR ART) Fig. 1
FIG. 1 is a cross-sectional view of a prior art mattress.

As illustrated in FIG. 1, prior art mattresses that utilize a dual chamber design have a structure that includes a top layer of vinyl 10, a bottom layer 12, and one or more intermediate layers 14. The sides of such mattresses are enclosed by one or more generally vertical strips of vinyl 16. In order to maintain a relatively consistent vertical height across the surface of the mattress, multiple internal vertical ribs 18 are also provided. More specifically, two separate sets of these ribs are provided, one set being incorporated into the top chamber of the mattress and the second set positioned in the bottom chamber.

In this arrangement, the intermediate layers 14 of the prior art mattress extend entirely from side to side within the mattress. Each set of vertical ribs within the mattress must, therefore, be secured to both the intermediate layer and to either the top or bottom layer of the mattress. In a very real sense, the prior art dual chamber mattresses have required the creation of two separate mattresses that are joined together. The arrangement of these prior art mattresses, and, in particular, the separate sets of vertical beams required therein, require a significant amount of labor and, due to the shear number of seams required to secure the separate sets of beams, present an increased chance of defects occurring in the product.

Figure 2:
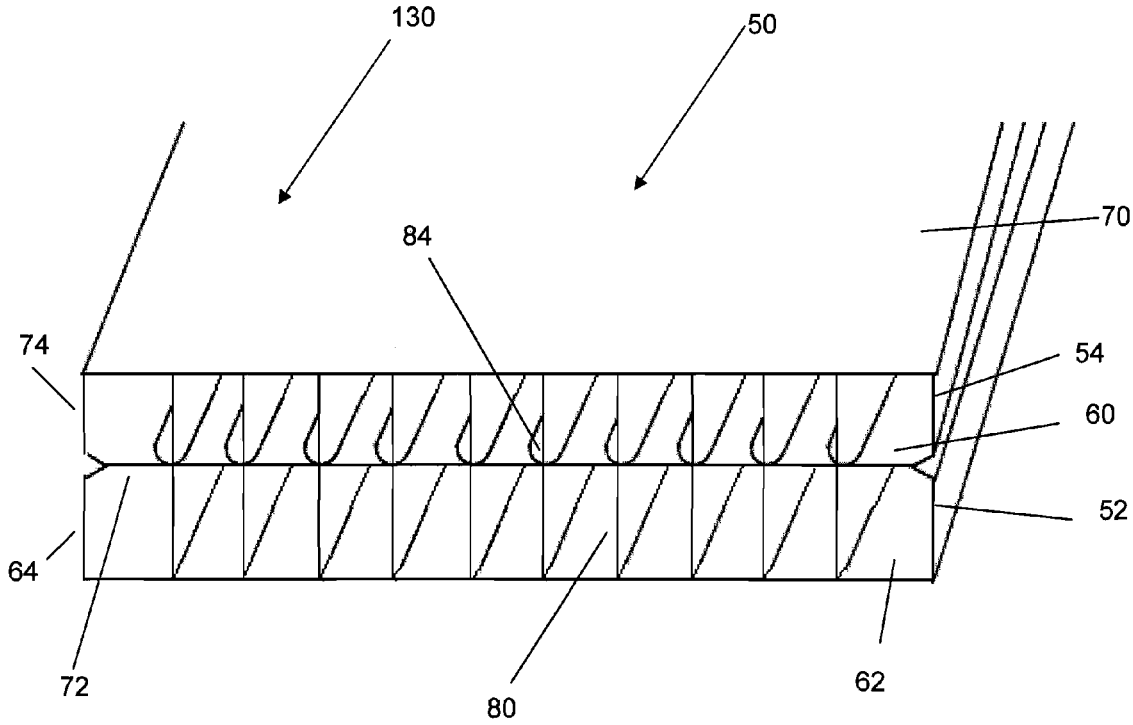
FIG. 2 is a cross-sectional view of a mattress according to an embodiment of the present invention.
Figure 3:
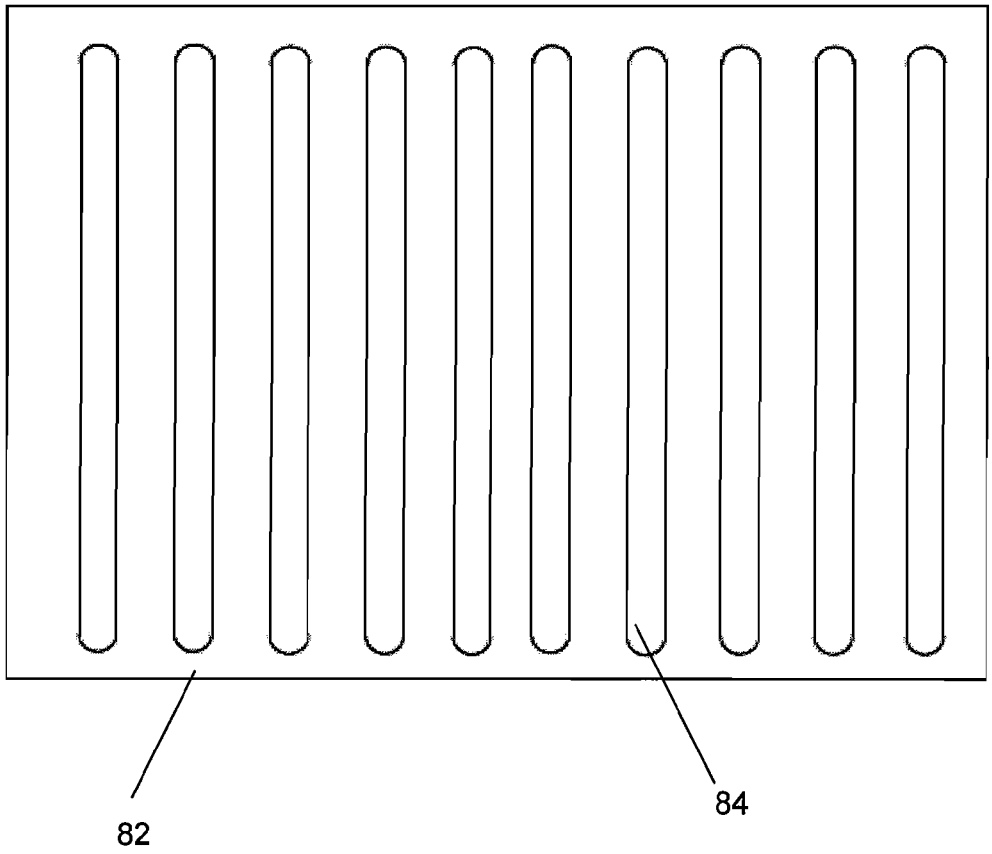
FIG. 3 is a plan view of an internal horizontal layer that is suitable for use in a mattress according to one or more embodiments of the present invention.

Turning to the embodiments of the present invention and more specifically to FIG. 2, an air mattress 50 of the present invention includes a first inflatable compartment 52 having a length and width, when inflated, sufficient to support a human body. Compartment 52 is composed of a first sheet 60 forming a top of the compartment, a second sheet 62 forming a bottom of the compartment, and a strip 64 forming the sides of the compartment. Preferably the first inflatable compartment 52 may be inflated by means of a standard inflate, or inflate/deflate, valve disposed at a convenient location in the wall of compartment 52.

Air mattress 50 also includes a second inflatable compartment 54 disposed on the top 60 of the first inflatable compartment 52 and secured thereto at least along a portion of the first inflatable compartment. Second compartment 54 extends generally the length and width of the top of the first compartment 52 and is of a size, when inflated, sufficient to support a human body. The second compartment 54 is composed of a first layer 70 forming the top of the second compartment, a second layer 72 forming the bottom of the second compartment, and a strip 74 forming the sides of the second compartment.

The bottom 72 of the second compartment 54 and the top 60 of the first compartment 52 may be composed of a single, common layer of material or of separate layers. Similarly, the strips 64, 74 from the sides of the first and second compartments may comprise either a single piece of material or separate pieces without affecting the nature of the present invention.

It is preferred that the compartments have a single inflation/deflation valve, and that the inflation air for the second compartment flows initially into the first compartment. Of course, the single inflation/deflation valve could be disposed in a wall of the second compartment instead, in which case inflating air flow would be from the second compartment to the first.

As is more clearly illustrated in FIGS. 2-7, the lowermost and uppermost horizontal layers of the mattress are connected internally by a plurality of spaced vertical members 80. These vertical members 80 extend transversely across the width of the mattress. As will be described in more detail below, these vertical members encompass a number of different embodiments within the scope of the present invention.

Figure 4:
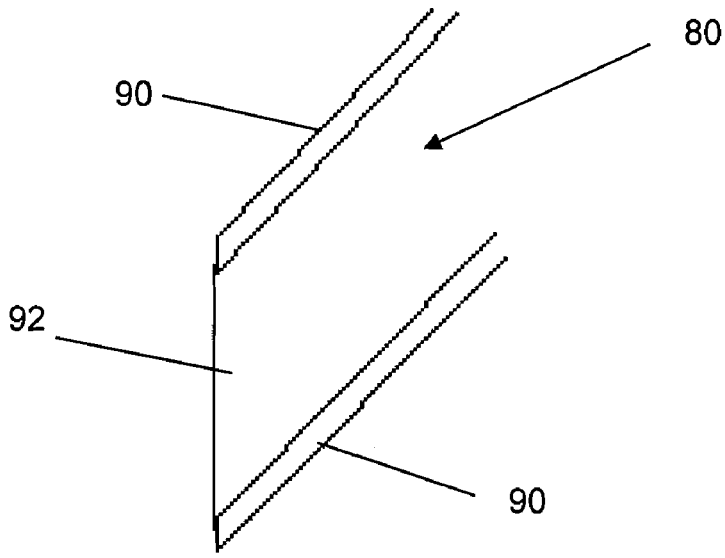
FIG. 4 is an enlarged cross-sectional view of an internal vertical member from the mattress of FIG. 2.

As previously noted, the top 60 of the first compartment and bottom 72 of the second compartment may be formed from either a single or multiple layers of material. In the case of the embodiment illustrated in FIGS. 2-7, these items are formed from a single layer of material 82. This layer of material possesses at least one opening 84 and, preferably, as many openings as there are internal vertical members 80 in the mattress. In the preferred embodiment, the position and alignment of these openings 84 in the internal horizontal layer 82 will generally correspond to the position of the internal vertical members 80. This arrangement allows the internal vertical members 80 to pass through the internal horizontal layer 82 without interruption, which removes the necessity for a seam between the internal vertical members 80 and the internal horizontal layer 82. More specifically, this arrangement results in a fifty percent (50%) reduction in the number of seams in the mattress, thereby greatly reducing the labor required to manufacture the mattress and the number of seam sites that can later fail. Advantageously, this arrangement also naturally provides confluence between the two chambers of the mattress. FIG. 4 illustrates one embodiment of an internal horizontal layer of this general arrangement.

It should be noted that while a preferred embodiment in which the internal horizontal layer 82 is provided with openings 84 to allow the free passage of the internal vertical members 80 has been shown and described, an arrangement in which the internal vertical members possess openings to allow the horizontal layer 82 to pass therethrough is also encompassed within the scope of the present invention. In such an embodiment, each internal vertical member would possess one or more openings therein to accommodate the passage of the horizontal layer. Once again, this arrangement would allow for the desired structure and support of the two chamber mattress while eliminating approximately half of the typically required internal seams in the mattress. Similarly, it is also contemplated that openings in both the internal vertical members and the internal horizontal layer may be utilized.

The internal vertical members 80 themselves can take a number of different forms. In a first embodiment illustrated in FIG. 3A, the internal vertical members 80 include three separate parts. The members 80 are provided with two vertically spaced apart bases 90 that are secured to the top and bottom layer of the mattress. These bases 90 are made of a vinyl material to facilitate seaming to the layers of the mattress in a known manner, including, for example, sonic welding. A middle section 92 is stretched between and secured to each of the bases 90. The middle section 92 in the illustrated embodiment is a panel, preferably composed of a stretch fabric material, such as spandex or certain polyester materials. It is also possible to utilize natural materials, such as cotton.

The use of a stretch fabric for the middle section provides a number of benefits over the prior art. Stretch polyester, in particular, represents a significantly less inexpensive and more readily sourced material option relative to vinyl. Such materials also typically weigh less than comparably sized pieces of vinyl, thereby reducing the overall weight of the mattress by a significant margin, given the number of internal vertical members that are typically used in a mattress. In addition, the use of a stretch fabric enhances the actual performance of the mattress. The greater elasticity of the fabric relative to vinyl leads to additional resilience in the mattress, which imparts a more "natural" feel that is more similar to a traditional innerspring mattress. The greater elasticity also results in a more durable mattress that resists bursting when heavily loaded better than traditional vinyl members. Finally, the reduction in the use of vinyl that results from utilizing a fabric material represents an improvement of the environmental "footprint" of the mattress. This last feature can be further emphasized through the use of polyesters manufactured from recycled material.

The above qualities can be extended to the internal horizontal layer 82 by utilizing the same or a similar fabric material for this piece as well.

Figure 5:
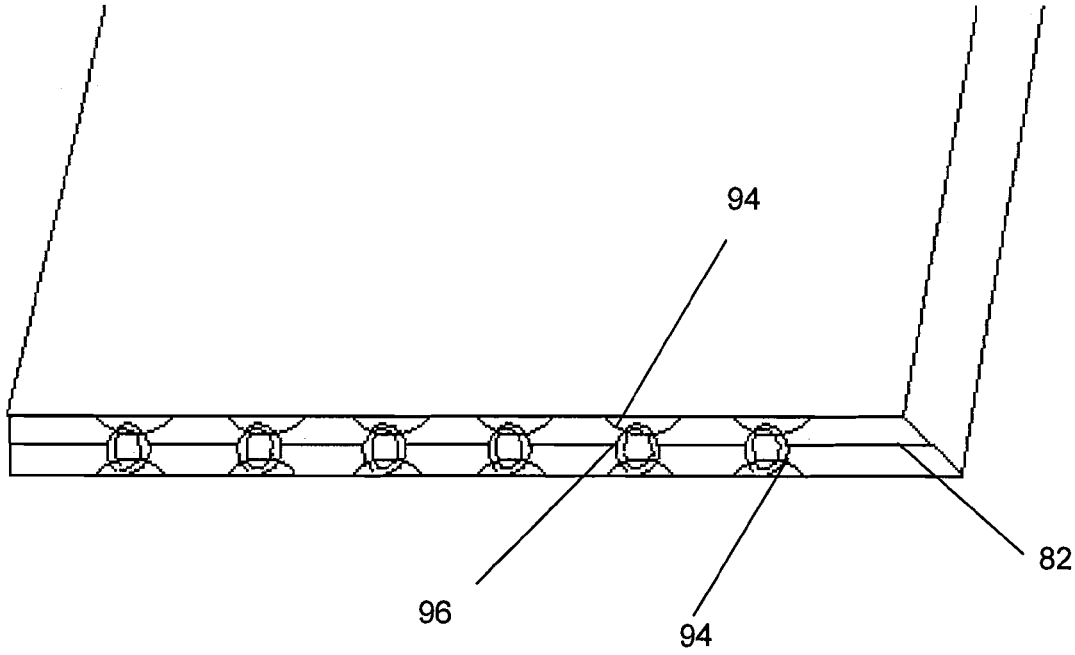
FIG. 5 is a cross-sectional view of a mattress according to another alternative embodiment.
Figure 5A:
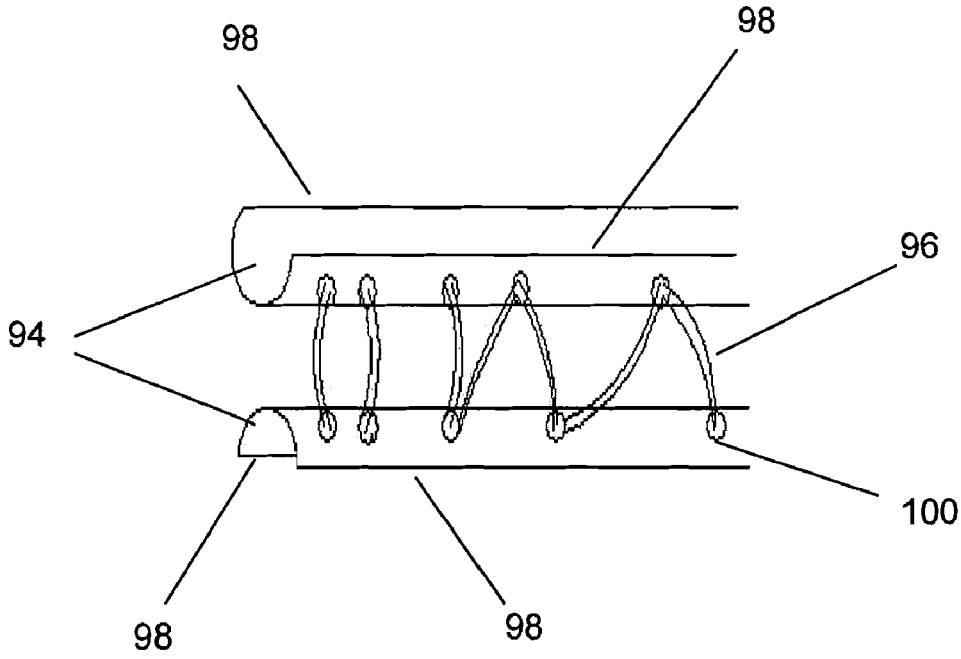
FIG. 5A is an enlarged cross-sectional view of an internal vertical member from the mattress of FIG. 5.
Figure 6:
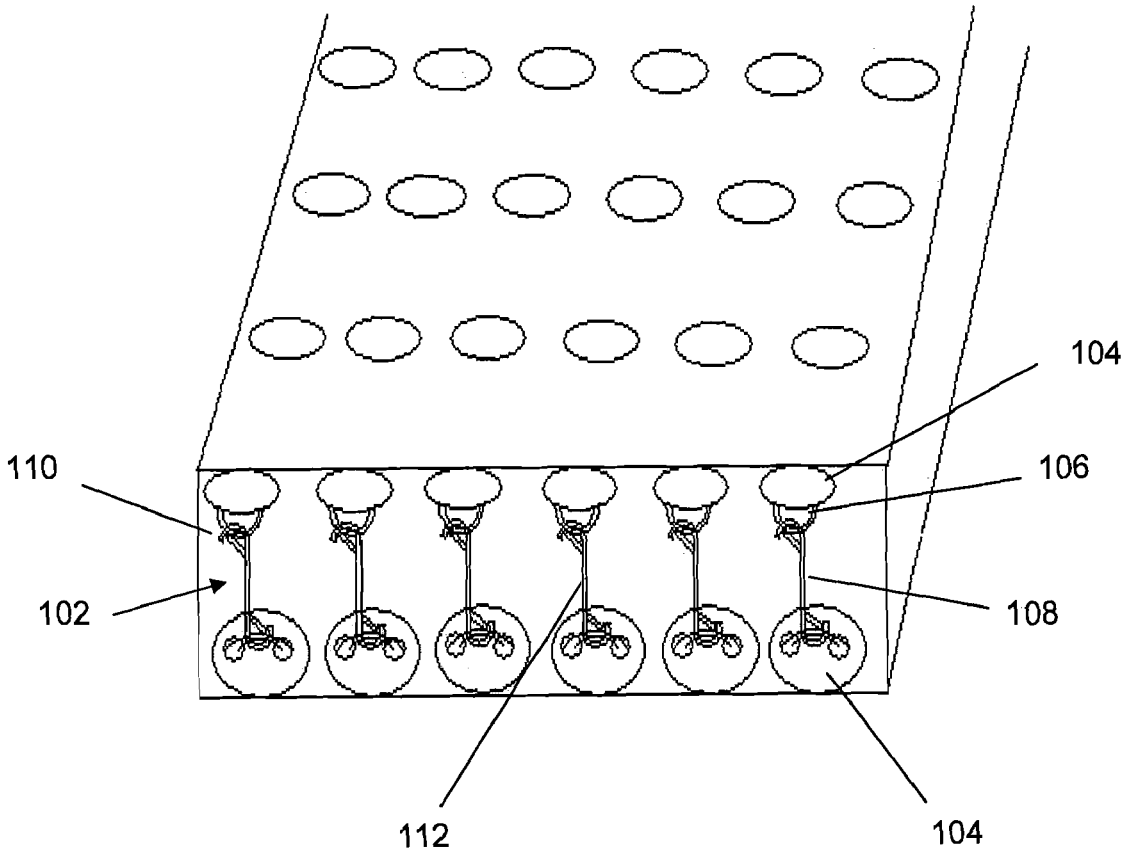
FIG. 6 is a cross-sectional view of a mattress according to another alternative embodiment.
Figure 6A:
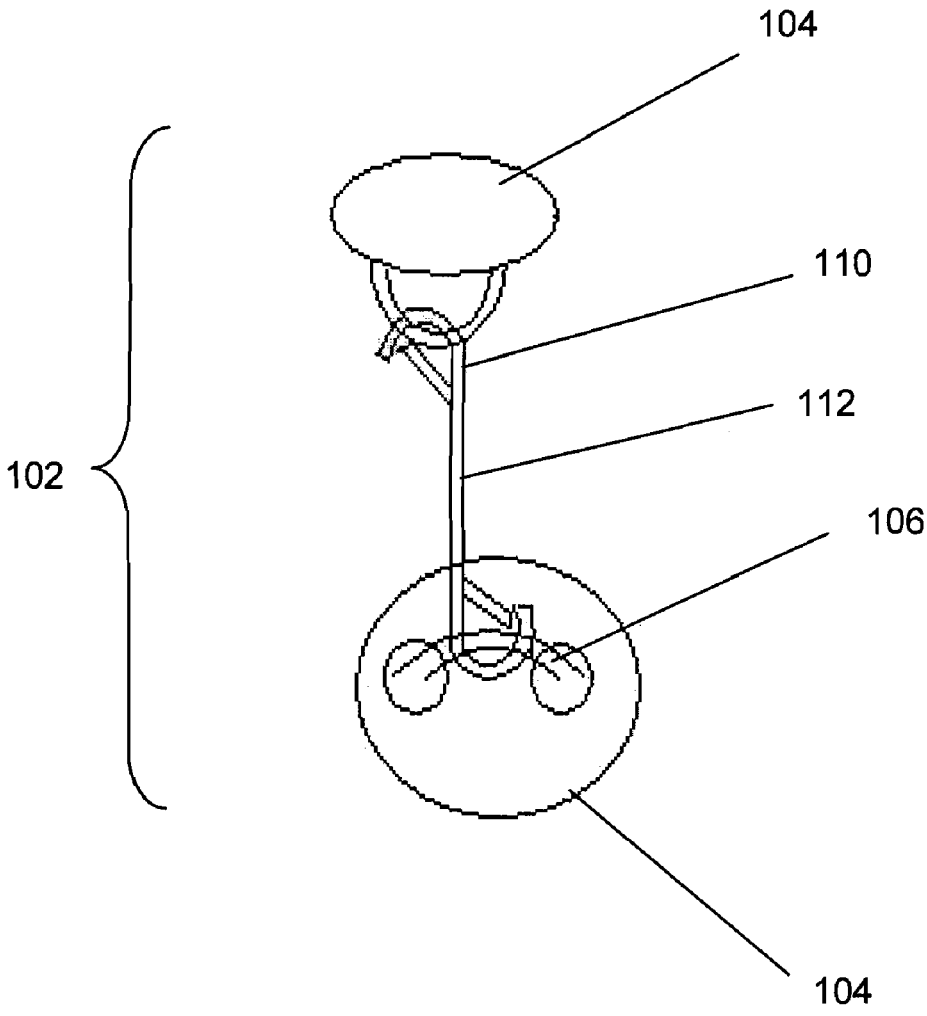
FIG. 6A is an enlarged cross-sectional view of an internal vertical member from the mattress of FIG. 6.
Figure 7:
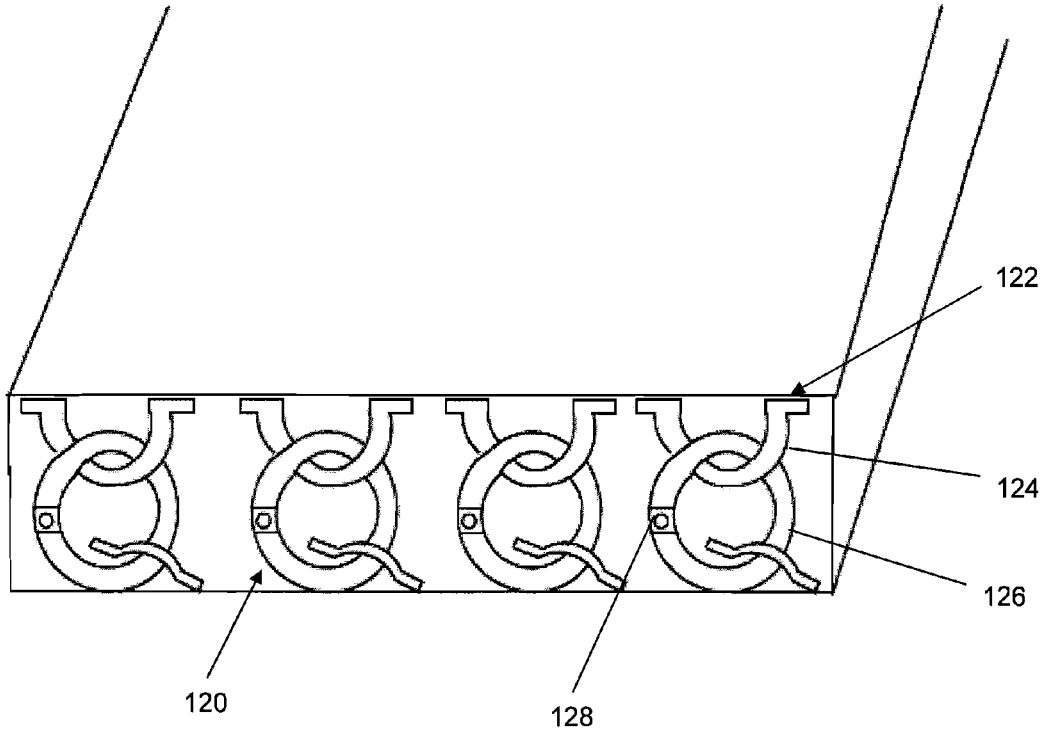
FIG. 7 is a cross-sectional view of a mattress according to another embodiment.
Figure 7A:
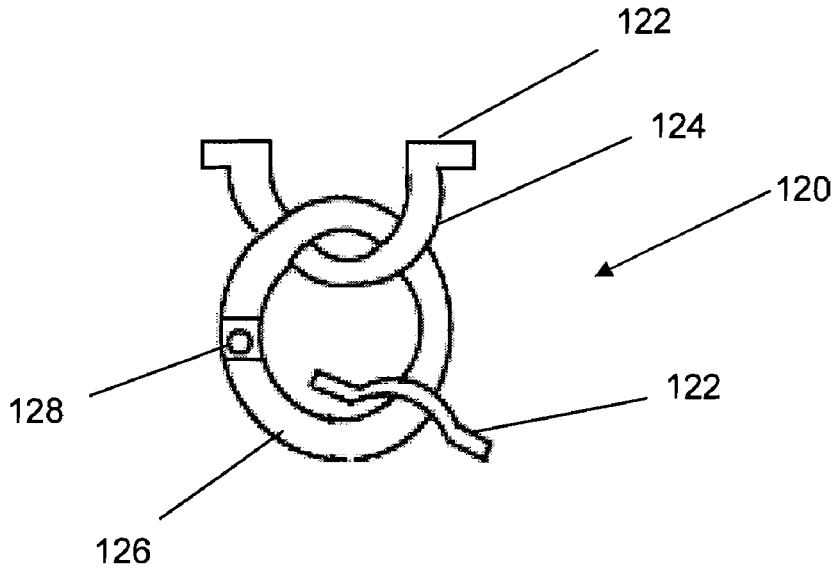
FIG. 7A is an enlarged cross-sectional view of an internal vertical member from the mattress of FIG. 7.

FIGS. 5A, 6A, and 7A illustrate alternate embodiments for the internal vertical members 80. For the sake of clarity in some of the figures, the internal horizontal layer 82 is not shown.

In the embodiment of FIG. 5A, the bases 94 are formed from elongated strips of material, for example, vinyl. These strips 94 are secured to the top and bottom layer of the mattress transverse to the long axis of the mattress. In a preferred version of this embodiment, the strips 94 are secured to the top and bottom layers along the two long edges 98 of each strip 94. When the strips 94 are connected to one another by the middle section 96, this arrangement results in the strips forming a generally semi-circular shape when viewed in cross-section. The middle section 96 is formed by fabric loops that are based through vent holes 100 in the strips 94. The middle section 96 can be formed by many loops or by a single extended cord that is alternately looped between the top and bottom strips as it extends from one side of the mattress to the other.

FIG. 6A illustrates yet another embodiment in which each vertical member 80 is actually formed by rows of individual restraints 102. Each restraint 102 includes a base 104 that is secured to the top or bottom layer of the mattress. The bases 104 include a flat circular foundation 104 with a semi-circular loop 106 attached thereto. The middle section of the restraint 102 includes an extended "S"-shaped tether 108. This tether 108 includes plastic clasps 110 at each end that are connected by a cord 112 preferably made of a stretch fabric. The plastic clasps 110 allow the tether 108 to be readily connected to the semi-circular loops 106 of the bases 104. This particular embodiment possesses the advantage of not requiring seaming, welding, stitching or another similar process to connect the constituent pieces of the restraints 102.

The embodiment of FIG. 7A possesses similarities to both of the prior embodiments. As with the embodiment of FIG. 6A, it utilizes rows of individual restraints 120 to form the vertical members of the mattress. The restraints include bases 122 that are formed by semi-circular loops 124 that are created by securing the ends of a vinyl strap to the top or bottom layer of the mattress. In a similar manner to the embodiment of FIG. 5A, the bases 122 are connected to one another by a fabric loop 126. In a preferred embodiment, the fabric loops 126 are created from a strip of material in which the ends are secured to one another by any suitable means after the strip has been threaded through both the upper and lower bases 122. In the illustrated embodiment, the ends of fabric strip are secured by a plastic rivet 128. However, those of skill in the art will generally recognize multiple alternative methods of connecting the ends, including, for example, sewing.

Figure 8:
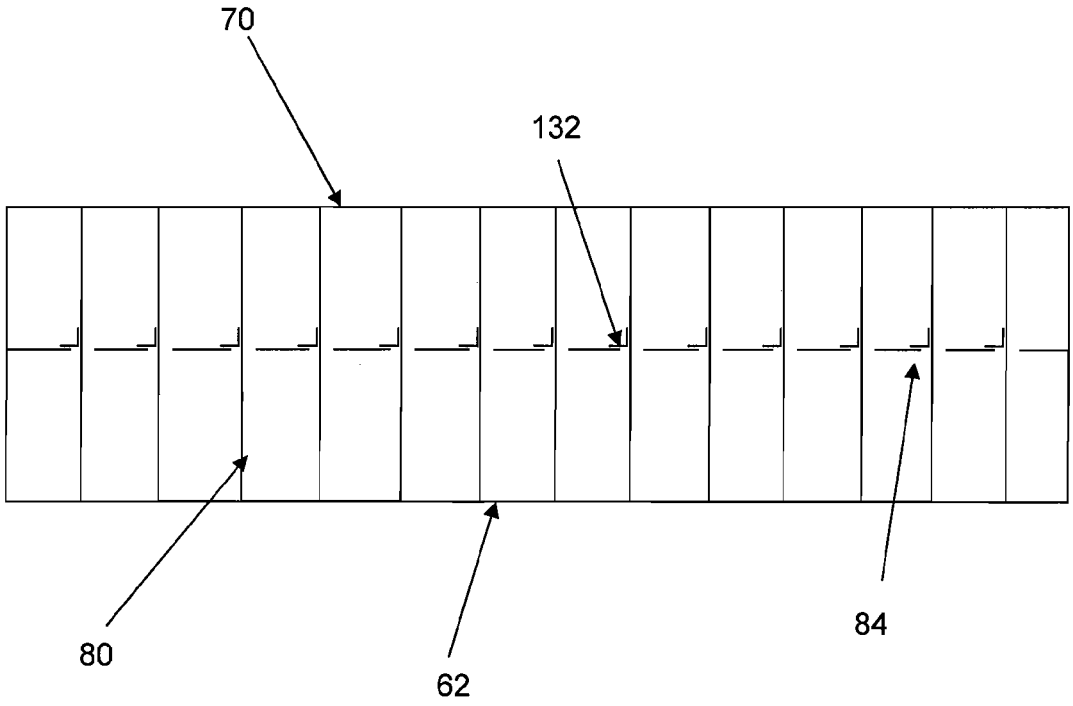
FIG. 8 is a cross-sectional view of an alternate embodiment of the mattress shown in FIG. 2.

FIG. 8 illustrates a variation of the mattress structure shown in FIG. 2 and described above. While the basic structure of the mattress is similar to the previously disclosed embodiment, there is an additional flange member 132 attached to the vertical members 80 and to the internal horizontal layer 82 to provide additional stability to the mattress if desired. This modification can be incorporated into the other embodiments shown and described herein. As with the other internal structural components of the embodiments described herein, the flange member 132 can be made from a stretch fabric material for improved failure resistance and lighter weight. The flange member 132 can be attached to the vertical member 80 and internal horizontal layer 82 by sewing, sonic welding, dielectric seaming, or other known method. The flange member 132 can be of a shorter length than the vertical member 80, in which case multiple flange members 132 may be used to connect each vertical member and the internal horizontal layer, or the same length. Further, flange members 132 may be utilized with only selected vertical members 80 rather than all such members.

The enhanced comfort and environmental qualities of the above described embodiments can be further enhanced through the use of an improved arrangement for the upper surface of the top layer 70 of the mattress 50. In such an embodiment, the upper surface is provided with a flocked surface 130 formed from natural fibers. In a particularly preferred embodiment, bamboo is used for the flocking fibers of the surface 130. Bamboo is first processed into finely cut fibers. An adhesive material is then applied to the upper surface of the mattress 50. The upper surface is then ionized by applying an electric field to the surface. The ionized surface attracts the flocking fibers to the surface in a relatively even layer. The adhesive then secures the fibers to the upper surface as the adhesive dries. The bamboo flocked surface provides natural anti-microbial properties and wicks excess moisture away from the user. Bamboo also represents a widely available and renewal natural resource. In addition to bamboo, both cotton and wool also present similar advantageous qualities are encompassed within the scope of the present invention.

It should be appreciated that the air mattress of the present invention may be constructed in various sizes and shapes. It may be packaged and sold or stored in a bag, if desired.

Other objects, features and advantages of the present invention will be apparent to those skilled in the art. While preferred embodiments of the present invention have been illustrated and described, this has been by way of illustration and the invention should not be limited except as required by the scope of the appended claims and their equivalents.

What is claimed is:

1. An air mattress comprising:

an inflatable compartment having a length and width, when inflated, sufficient to support a human body;

said inflatable compartment having a top, bottom, and sides, said top and bottom being generally parallel to one another;

an internal, generally horizontal wall substantially extending along the length and the width and being located between said top and said bottom, said internal, generally horizontal wall connected at least at a first location to and horizontally restraining said sides, at least one internal member connected to and restraining the relative vertical movement of said top and bottom of said inflatable compartment; and wherein one of said at least one internal member and said internal, generally horizontal wall defining an elongated opening therein permitting at least a portion of the other of said at least one internal member and said internal, generally horizontal wall to pass therethrough without interruption.

2. The air mattress of claim 1, wherein said at least one internal member comprises first and second bases, said first base attached to said top of said inflatable compartment and said second base attached to said bottom of said inflatable compartment, and a middle section extending between and connecting said first and second bases.

3. The air mattress of claim 2, wherein said middle section comprises an elastic material.

4. The air mattress of claim 2, wherein said first and second bases comprise a vinyl material.

5. The air mattress of claim 2, wherein said middle section comprises a panel of material.

6. The air mattress of claim 2, wherein:

said first and second bases each comprise a strip of material having a length and a width, said length of said strip being substantially greater than said width of said strip, said length of said strip extending along said width of said internal compartment, said strip having first and second edges extending along the length of said strip, and said strip being connected to one of said top and bottom of said inflatable compartment at said first and second edges of said strip;

said strip defines a series of holes therein; and said middle section comprises a plurality of loops passing through said holes to engage said panel.

7. The air mattress of claim 2, wherein said first and second bases each comprise a closed loop and said middle section comprises first and second hook structures, said first hook engaging said closed loop of said first base and said second hook engaging said closed loop of said second base, and an elastic section connecting said first and second hook structures.

8. The air mattress of claim 2, wherein:

said first and second bases each comprise a strip of material attached to one of said top and bottom of said inflatable compartment adjacent first and second ends of said strip of material; and said middle section comprises a loop connecting said first and second bases.

9. The air mattress of claim 1, wherein said internal, generally horizontal wall comprises an elastic material.

10. The air mattress of claim 9, wherein said elastic material is a stretch polyester.

11. The air mattress of claim 1, wherein said other of said at least one internal member and said internal, generally horizontal wall passes through said opening in said one of said at least one internal member and said internal, generally horizontal wall without connection of said at least one internal member and said internal, generally horizontal wall with each other.

12. The air mattress of claim 1, further comprising a second inflatable compartment adjacent to and connected with said first inflatable compartment, said second inflatable compartment having a length and width, when inflated, sufficient to support a human body;

said second inflatable compartment having a top, bottom, and sides, said top and bottom being generally parallel to one another;

an internal, generally horizontal wall located between said top and said bottom of said second inflatable compartment, said internal, generally horizontal wall connected at least at a first location to and horizontally restraining said sides of said second inflatable compartment, and at least one internal member connected to and restraining the relative vertical movement of said top and bottom of said second inflatable compartment;

one of said at least one internal member and said internal, generally horizontal wall defining an opening therein permitting at least a portion of the other of said at least one internal member and said internal, generally horizontal wall to pass therethrough without interruption.

13. The air mattress of claim 1, further comprising:

a second internal, generally horizontal wall located between said top and said bottom, said second internal, generally horizontal wall connected at least at a first location to and horizontally restraining said sides of said second inflatable compartment; and one of said at least one internal member and said second internal, generally horizontal wall defining an opening therein permitting the other of said at least one internal member and said second internal, generally horizontal wall to pass therethrough without interruption.

14. The air mattress of claim 1, further comprising a layer of natural fibers flocked to said top of said inflatable compartment.

15. The air mattress of claim 14, wherein said layer of natural fibers comprises bamboo fibers.

16. The air mattress of claim 14, wherein said layer of natural fibers comprises cotton fibers.

17. The air mattress of claim 1, further comprising a flange member attached to said at least a portion of said at least one internal member and to at least a portion of said internal, generally horizontal wall.

18. In a mattress having an inflatable compartment having a length, a width, a top, bottom, and sides and an internal, generally horizontal wall substantially extending along the length and the width and being located between said top and said bottom, said internal, generally horizontal wall serving to horizontally restraining said sides, the improvement comprising:

at least one internal member connected to and restraining the relative vertical movement of said top and bottom of said second inflatable compartment, wherein one of said at least one internal member and said internal, generally horizontal wall define an elongated opening therein permitting at least a portion of the other of said at least one internal member and said internal, generally horizontal wall to pass therethrough without interruption.

19. A method of fabricating an inflatable mattress, comprising the steps of:

forming an inflatable compartment having a length and width, when inflated, sufficient to support a human body from a top, bottom, and sides, said top and bottom being generally parallel to one another;

providing an internal, generally horizontal wall substantially extending along the length and the width and being located between said top and said bottom, and connecting said internal, generally horizontal wall at least at a first location to said sides, said internal, generally horizontal wall horizontally restraining relative horizontal movement of said sides;

providing at least one internal, generally vertical member and connecting said at least one internal generally vertical member to of said top and bottom of said inflatable compartment, said at least one internal generally vertical member restraining relative vertical movement of said top and bottom; and providing an elongated opening in one of said at least one internal generally vertical member and said internal, generally horizontal wall, said opening permitting at least a portion of the other of said at least one internal, generally vertical member and said internal, generally horizontal wall to pass therethrough without interruption.

* * * * *